US005219229A

United States Patent [19]

Sengewald

[11] Patent Number: 5,219,229

[45] Date of Patent: Jun. 15, 1993

[54] PACKING, IN PARTICULAR A PACKING FOR COMPRESSIBLE PACKED GOODS

[75] Inventor: Karl-Heinz Sengewald, Halle/Westf, Fed. Rep. of Germany

[73] Assignee: Karl-H. Sengewald GmbH & Co. KG, Fed. Rep. of Germany

[21] Appl. No.: 755,955

[22] Filed: Sep. 6, 1991

[30] Foreign Application Priority Data

Sep. 7, 1990 [DE] Fed. Rep. of Germany ..... 4028508

[51] Int. Cl.[5] ..... B65D 30/20; B65D 33/08

[52] U.S. Cl. ..... 383/207; 383/10; 383/66; 383/120; 383/208

[58] Field of Search ..... 383/10, 66, 120, 206, 383/209, 207, 208

[56] References Cited

U.S. PATENT DOCUMENTS 3,315,866 4/1967 Kersh et al. ..... 229/216 X
3,663,239 5/1972 Rowe et al. ..... 383/209 X
4,966,286 10/1990 Muckenfuhs ..... 338/66 X
4,986,673 1/1991 Bell ..... 383/204 X
5,050,742 9/1991 Muckenfuhs ..... 383/66 X
5,054,619 10/1991 Muckenfuhs ..... 383/66 X

FOREIGN PATENT DOCUMENTS 0349050 6/1989 European Pat. Off. .

*Primary Examiner*—Stephen P. Garbe
*Assistant Examiner*—Jes F. Pascua
*Attorney, Agent, or Firm*—Diller, Ramik & Wight

[57] ABSTRACT

The packing includes a side-folds bag (10). For opening the same, tear lines (22) are provided that start at the handle (18) and extend congruently at first. In the upper wall portions (14*a*, 14*b*), the tear lines diverge towards the corners (23), ending in the end wall (12) or converging again. For tearing the bag open, one has to pull at the four-layered portion (21) of the handle (18). The tearing is then done in a controlled manner with a take-out opening being made in the upper wall (14), which opening may extend into the end wall (12).

9 Claims, 3 Drawing Sheets

PACKING, IN PARTICULAR A PACKING FOR COMPRESSIBLE PACKED GOODS

The invention relates to a packing, and particularly to a packing with a side-folds bag of a rectangular structure.

Packings for baby diapers, sanitary napkins and other flexible goods to be packed are more and more designed such that the goods to be packed are filled into a bag in a compressed state with the bag being closed thereafter. Bags to be used for such goods to be packed may be side-folds bags. These are bags that are made from a hose material with inwardly folded side folds. Upon filling the bags, the side folds constitute the end walls of the bag. In order to remove the contents of the packing, the bag has a perforation. Usually, such a perforation is provided at one of the main walls of the bag. The user may grip into the main wall and pull out a flap defined by the perforation. In the case of compressed packed goods, the packing will be warped and deformed since the main walls absorb the tensile stresses exerted by the packed goods.

From European Patent 0 349 050 A2 a packing is known, wherein compressed packed goods are contained in a side-folds bag. As an opening device, one of the end walls has a perforation defined by tear lines, which extends only over a part of the width of this end wall to form a flap. When tearing open the flap, the lateral portions of the end wall remain untouched so that the rectangular configuration of the bag is substantially maintained and the end wall still keeps the packed goods in a compressed state. The packed good may be removed by lateral deformation through the opening thus obtained. It is a drawback of this packing that opening the same requires gripping into the end wall of the bag with the fingers in order to grasp a part of the flap defined by the tear lines and to pull it open thereafter. A handle may be provided at the flap, yet this requires an additional production effort and additional material. However, the handle does not ensure a controlled breaking of the tear line. Thus, the bag material may be torn other than along the tear line. Due to the remaining portions of the end wall, taking the articles out of the bag is difficult.

It is an object of the invention to provide a packing that may be opened easily and in a controlled manner, the breaking of the tear lines being performed easily and with high precision at a well accessible location.

The packing of the present invention consists of a side-folds bag with a handle part. Such a side-folds bag is made from a hose of foil material or paper material and is provided with side folds in a manner known per se. First, this hose is transversely welded or sealed along two joint seams. These joint seams define the handle part in which a handle opening may be provided simultaneously or at a later time. Subsequently, the bag is spread open at its lower end in order to fill in the filling goods. Then, the bottom wall of the bag is closed. Such a side-folds bag has a handle projecting upwards from the chamber for the goods to be packed and consisting of elongations of the side walls. The handle part is substantially two-layered, but has four-layered portions at its ends where the inwardly folded elongations of the side walls are located. In such a bag with a projecting handle part, it is contemplated that the tear lines are provided at the handle part and in the wall portions of the upper wall. In order to open the bag, the handle part is held in both hands, one hand grasping the man part of the handle part, while the other hand grasps the tear-off part of the handle part. Thus, tearing open is started by grasping a single (multi-layered) wall formed by the handle part. This allows a controlled breaking of the tear lines. After the tear lines have been torn along the handle part, the tearing process is continued in the single-layered wall parts of the upper wall. Thus, a tear-open flap is formed in the upper wall that extends to the end wall of the bag. The contents of the bag may be taken therefrom through the generally triangular opening exposed by the tear-open flap. However, the tear-open flap may also extend into the end wall of the bag. The portion extending into the end wall may be of triangular, parabolic or any other shape with parts of the end wall generally being left untouched in order to withstand the pressure of the compressed packed goods.

By partly opening the upper wall of the bag, its resistance against compressed packed goods is not substantially reduced. On the one hand, the main walls of the bag absorb most of the tensile stresses and, on the other hand, only an approximately triangular opening is formed in the upper wall so that the remaining wall portions can still tranfer tensile forces.

The side-folds bag of the packing of the present invention may be made of plastics foil, in particular polyethylene foil, or of paper having a hot-melt coating applied thereon. In both cases, the joint seams can be made in a simple manner by thermal means. After the tear-open flap has been torn off, the bag will keep its shape since the opening extends in a defined form only over such wall portions as do not absorb substantial forces in reaction to the force exerted by the compressible packed goods.

The following is a detailed description of embodiments of the invention with reference to the accompanying drawings.

In the Figures

Figure 3:
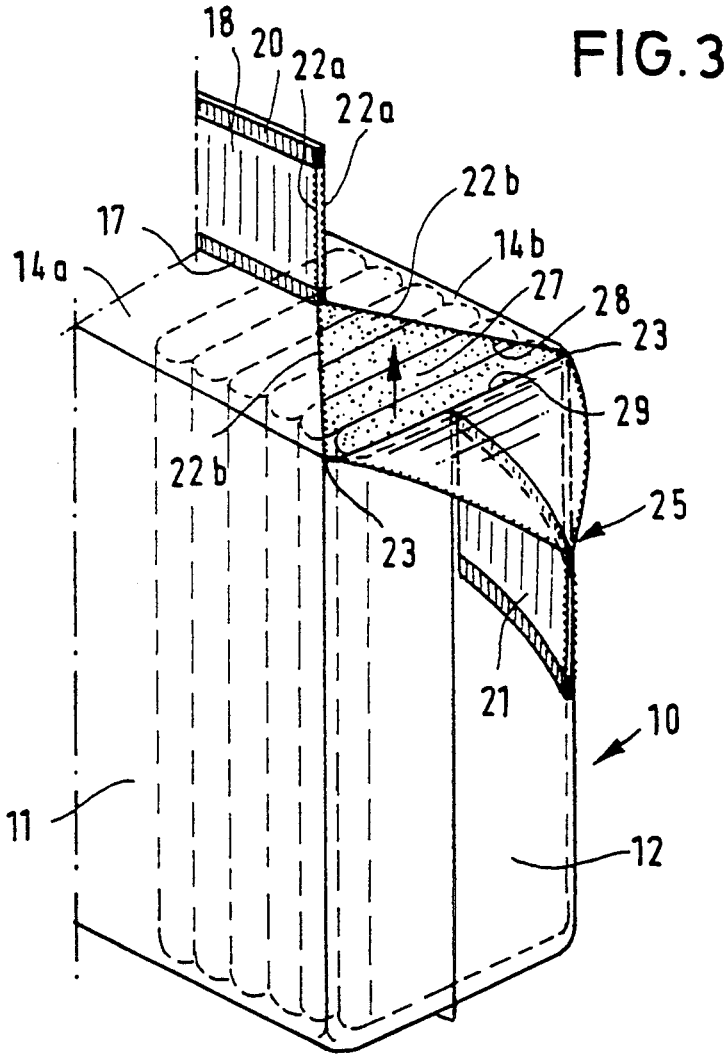
Figure 4:
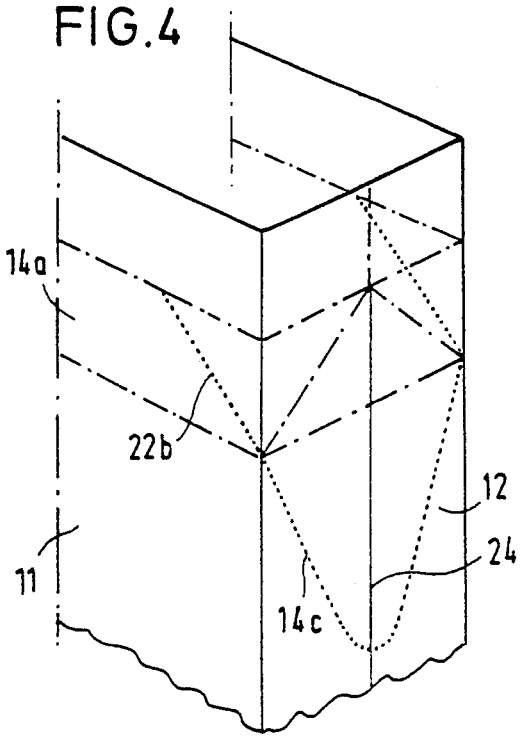
Figure 5:
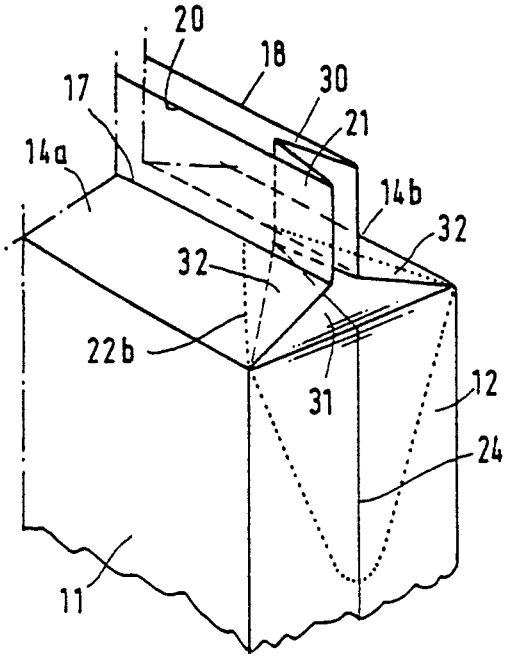
Figure 6:
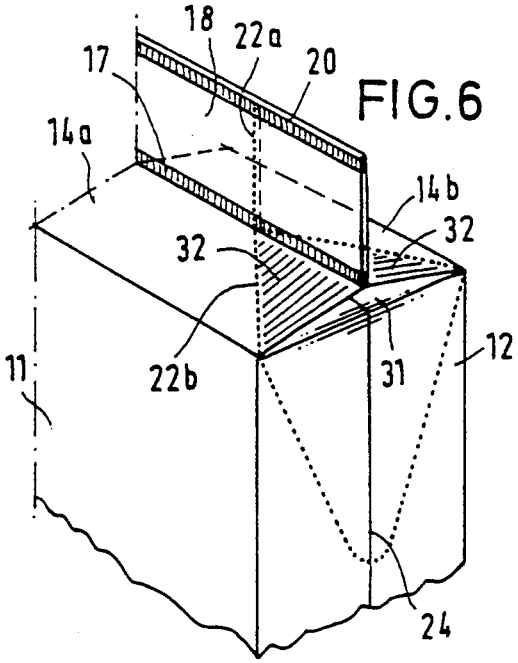
Figure 7:
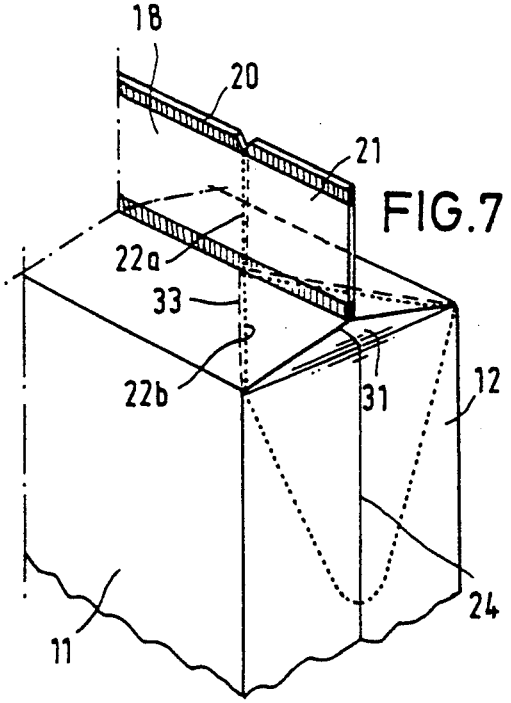

FIG. 3 is an embodiment in which the tear lines end near the bag corners so that the take-out opening is formed only in the upper wall, FIG. 4 shows the structure of the side-folds bag before the two transveral joint seams defining the handle part are provided, FIG. 5 is a schematic illustration of the closing of the upper wall and the forming of the handle part of the bag, FIG. 6 illustrates an embodiment in which the tear lines are formed along the wall parts of the upper walls by the limits of welded or sealed areas, and FIG. 7 shows an embodiment in which the tear lines are perforations that are underlaid by the lateral inward folds so that moistness cannot reach the packed goods directly through the perforations.

Figure 1:
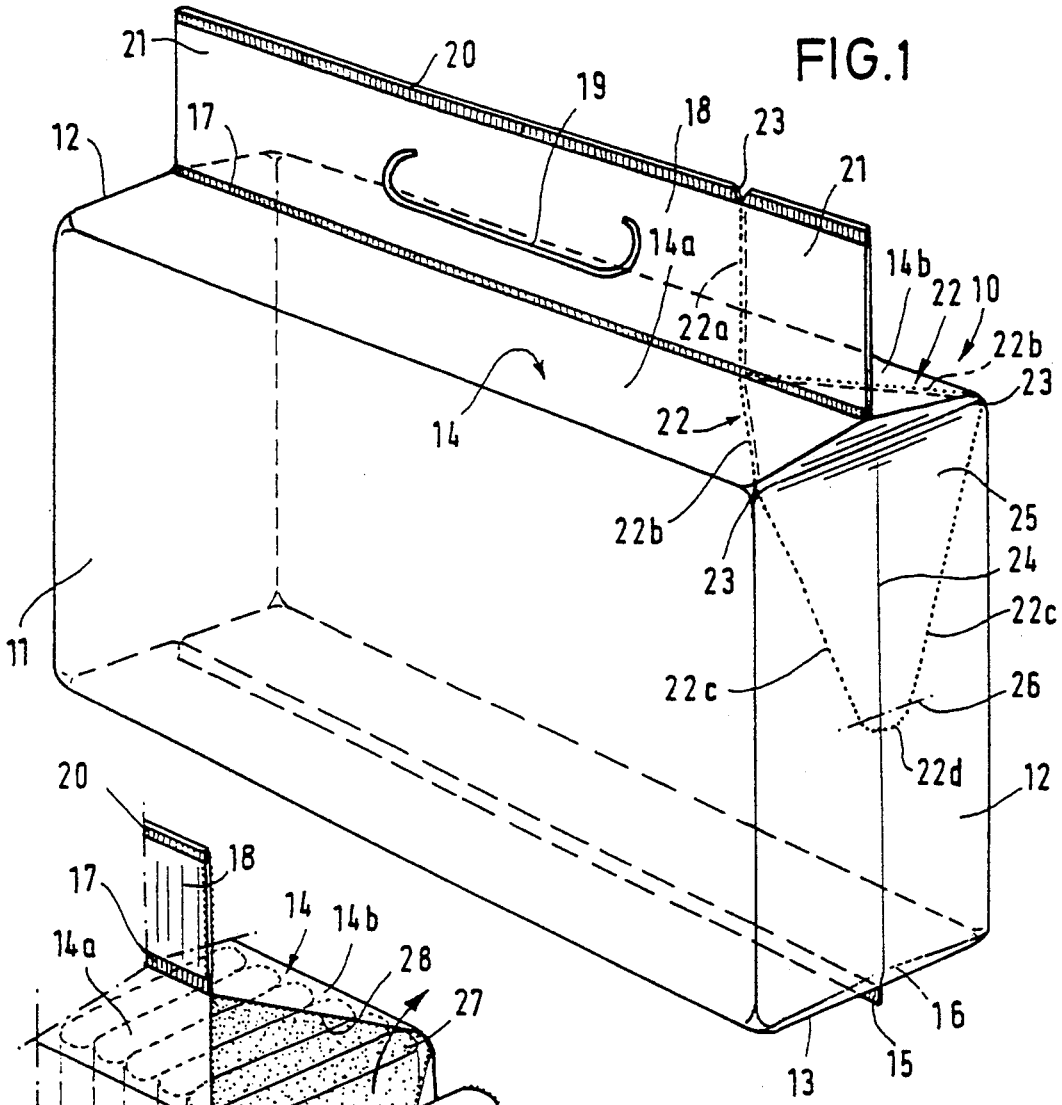
FIG. 1 is a perspective view of the packing in the closed state.

The packing of FIG. 1, illustrated in the filled and closed state, consists of a side-folds bag 10 of a generally parallelepipedic or rectangular shape and has two parallel main walls 11, two end walls 12, a bottom wall 13 and an upper wall 14. The bottom wall 13 is closed by a lower joint seam 15 which includes inward folds 16 of the end walls 12. However, a different kind of bottom folding may be provided.

The upper wall 14 consists of two top wall portions 14*a* and 14*b* that are projections of the main walls 11 and are connected through an upper joint seam 17 that extends from one end wall 12 to the opposite end wall 12. A rectangular handle part 18 projects from the upper joint seam 17 in the manner of a cock's blade, the handle part being provided with a punched out handle opening 19 and being defined by a further joint seam 20 at its upper end. The handle part 18 includes the two elongations of the main walls 11 or of the upper wall portions 14*a* and 14*b* and it is generally two-layered. Yet, at the ends, the handle part 18 has four-layered sections 21 in which the inward folds of the side folds 24 of the previous side-folds hose are located.

In order to open the closed bag, tear lines 22 are provided represented by dotted lines in the drawings. These tear lines 22 may be perforations, weakened lines or, as will be described hereafter, the weakened edges of welded or sealed areas.

A first tear line section 22*a* extends vertically from the joint seam 20 to the joint seam 17, traversing the handle part 18. This section 22*a* extends in the two-layered portion of the handle part 18 along the border to the four-layered portion 21. Thus, the four-layered portion 21 forms a strengthened handle that forms a part of the future tear-open flap. A tearing notch 23 is provided at the upper end of the section 22*a* for facilitating the breaking. In the section 22*a*, the tear lines 22 extend congruently in both layers. At the bottom point of the section 22*a*, namely the joint seam 17, the tear lines 22 diverge in the form of the parting sections 22*b* that each lead to the upper corner portions of the packing chamber, i.e. to the upper corners 23 of the respective end wall 12.

Figure 2:
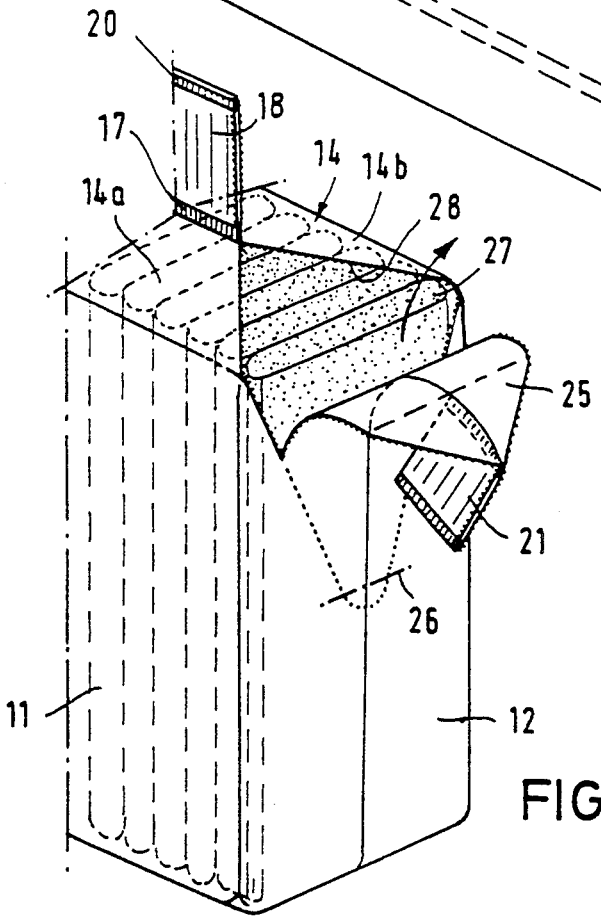
FIG. 2 is a partial view of FIG. 1 during the tearing off of the flap.

In the embodiment of FIGS. 1 and 2, further sections 22*c* of the tear lines 22 extend from the corners 23 into the end walls 12. These sections 22*c* converge and may be interconnected in a transition portion 22*d*. If a transition portion 22*d* is provided, the tear-off flap 25 defined by the tear lines 22 is torn from the bag 10 as a whole. However, if it is provided that the tear-off flap remains at the bag 10, the sections 22*c* are not interconnected as indicated in the drawings by a chain line 26.

FIG. 2 illustrates the tearing off of the flap 25 that is grasped at the four-layered portion 21 and drawn off. Thereafter, the packed goods 27 are exposed for removal. The packed goods may be baby diapers, for instance, filled into the bag 10 in a compressed state, the compression pressure acting between the end walls 12 of the bag. It is obvious that the triangular shape of the opening 28 in the upper wall 14 enables the upper wall to still transfer longitudinal forces between the end walls 12 and that the shape of the bag is not changed by tearing off the flap 25. Also the part of the opening 25 in the area of the end wall 12 leaves wall parts untouched over the entire height of the end wall.

In the embodiment of FIG. 3, the tear lines end at the corners 23 of the bag so that an opening is made only in the upper wall 14, but not in the end wall 12. FIG. 4 illustrates a part of the bag hose from which the bags 10 of FIG. 5 are made, the top wall sections 14*b* and 14*c* of the perforation being applied to the flat hose already in the bag making machine. Thereafter, the side folds 24 are folded inward and the joint seams 17 and 20 are produced on the flat hose provided with inwardly directed side folds. The illustration of FIG. 5 merely serves to explain the different layers and folds of the bag. During their production, the hose or the bag are never in the states illustrated in FIGS. 4 and 5 for detailing the bag structure. It is obvious from FIG. 5 that a two-layered portion exists at the handle part 18 and a four-layered portion 21 is provided at each end thereof, the same being obtained by the inward folds 30 of the extensions of the material of the end walls 12. Below the ends of the main wall portions 14*a* and 14*b*, further inward folds 31 are provided. There, these two-layered inward folds 31 and the top wall portions 14*a* and 14*b*, respectively, form triangular three-layered portions 32. The sections 22*b* of the tear lines 22 extend closely adjacent to the edges of the three-layered sections 32.

While the sections 22*b* and 22*c* of the tear lines 22 are already provided in the bag hose, it is suitable, to make the sections 22*a* only at the finished handle, i.e. when making the joint seams 17 and 20, or thereafter. Thus, it is easier to make the sections 22*a* congruent.

In the embodiment of FIG. 6, the two uppermost layers of the three-layered portions 32 are welded or sealed together, as indicated by the hatch lines. A weakened line generally occurs at the edge of a welded portion or a weld seam. By welding the portion 32 together, be it as a whole surface or along a line, a weakened line 22*b* is obtained so that the provision of a perforation is not necessary. It is a further advantage that the upper wall presents no holes in this area so that the packing remains water-tight. However, the sections 22*a* may be provided as perforations. A weld seam or a welded surface for joining the two upper layers of the three-layered portion 32 may be effected by inserting a welding tool into the gap of the fold and pressing another welding tool against the wall portion 14*a* or 14*b* of the upper wall 14 from outside.

In the embodiment of FIG. 7. the tear lines are perforations. In order to avoid water from reaching the packed goods directly from outside, these perforations are arranged above the fold 31, i.e. the edges 33 of the fold 31 project farther inward than the sections 22*b*. Water penetrating the perforation is kept from the packed goods by the fold 31.

In all embodiments, the section 22*b* of the tear lines extends along or at least near the edge of the fold 31. Thus, the tearing operation passes through the edge of the fold.

I claim:

1. A packing, in particular a packing for compressible packed goods, comprising a rectangular side-folds bag (10) having two main walls (11), two end walls (12), each of which is provided with a side fold (24), a bottom wall (13) and an upper wall (14), an upper joint seam (17) extending in the center of said upper wall (14), from which protrudes an upward projecting, at least two-layered handle part (18), and a tear-open flap (25) defined by tear lines (22), characterized in that said tear lines (22) are provided at said upward projecting handle part (18) and extend at least to the upper edge of one of said end walls (12), and portions of said tear lines (22) which are in the upper wall (14) include weakened edges adjacent welded surfaces (32).

2. The packing of claim 1, characterised in that said tear lines (22) extend congruently to each other in the area of said handle part (18) and that they diverge into top wall portions (14*a*, 14*b*) of said upper wall (14) below said upper joint seam (17).

3. The packing of claim 1, characterised in that said tear lines (22) extend obliquely to said top wall portions (14*a*, 14*b*) of said upper wall from said upper joint seam (17) to the corner portions (23) of the bag.

4. The packing of claim 1, characterised in that said tear lines (22) extend into said end wall (12).

5. The packing of claim 1, characterised in that said tear lines (22) are interconnected in the area of said end wall (12) such that said tear-open flap (25) may be separated from said bag.

6. The packing of claim 1, characterised in that said tear lines (22) extend at said handle part (18) along the fold of an inward directed folding (30), where a four-layered portion (21), consisting of the extensions of said end walls (12) and said main walls (11), borders a two-layered portion that consists only of extensions of said main walls (11), said tear lines (22) being provided in said two-layered portion.

7. The packing of claim 1, characterised in that said tear lines (22) are perforations.

8. A packing, in particular a packing for compressible packed goods, comprising a rectangular side-folds bag (10) having two main walls (11), two end walls (12), each of which is provided with a side fold (24), a bottom wall (13) and an upper wall (14), an upper joint seam (17) extending in the center of said upper wall (14), from which protrudes an upward projecting, at least two-layered handle part (18), and a tear-open flap (25) defined by tear lines (22), characterized in that said tear lines (22) are provided at said upward projecting handle part (18) and extend at least to the upper edge of one of said end walls (12), said inwardly directed folds (31) are welded as extensions of said end walls (12) to said top wall portions (14*a*, 14*b*) of said upper wall (14) at least along said tear lines (22), whereby weakened lines are formed at said wall portions of said upper wall (14) along the weld areas.

9. A packing, in particular a packing for compressible packed goods, comprising a rectangular side-folds bag (10) having two main walls (11), two end walls (12), each of which is provided with a side fold (24), a bottom wall (13) and an upper wall (14), an upper joint seam (17) extending in the center of said upper wall (14), from which protrudes an upward projecting, at least two-layered handle part (18), and a tear-open flap (25) defined by tear lines (22), characterised in that said tear lines (22) are provided at said upward projecting handle part (18) and extend at least to the upper edge of one of said end walls (12), and said tear lines (22) end in the area of said end wall (12), said tear lines (22) extend at said wall portions (14*a*, 14*b*) of said upper wall (14) along oblique folds (33) that are formed by inward directed folds (31) as extensions of said end walls (12), and said tear lines (22) are offset outwardly with regard to edges of said folds (33) in said upper wall (14) such that they lie outwardly of said edges of said folds (33) in said upper wall (14) and above said inward directed folds (31) and are underlaid thereby.

* * * * *